US006036728A

United States Patent [19]

Dvorsky

[11] Patent Number: 6,036,728

[45] Date of Patent: Mar. 14, 2000

[54] METHOD OF DYEING CONTINUOUS STRIPS OF TEXTILE FABRIC MADE OF POLYESTER FIBER OR MIXTURES OF POLYESTER WITH OTHER FIBERS, AND JIGGER FOR CARRYING OUT THE METHOD

[75] Inventor: Drahomir Dvorsky, Dvur Kralove, Czech Rep.

[73] Assignee: Eduard Kusters Maschinenfabrik GmbH & Co. KG, Krefeld, Germany

[21] Appl. No.: 09/077,153

[22] PCT Filed: Aug. 20, 1996

[86] PCT No.: PCT/DE96/01543

§ 371 Date: Aug. 24, 1998

§ 102(e) Date: Aug. 24, 1998

[87] PCT Pub. No.: WO97/19214

PCT Pub. Date: May 29, 1997

[30] Foreign Application Priority Data

Nov. 21, 1995 [DE] Germany ..... 195 43 314

[51] Int. Cl.[7] ..... D06B 1/02

[52] U.S. Cl. ..... 8/149.3; 68/5 C; 68/180; 8/151

[58] Field of Search ..... 68/56, 180; 8/149.3, 8/151

[56] References Cited

U.S. PATENT DOCUMENTS

| | | | |
|---|---|---|---|
| 2,271,874 | 2/1942 | Platt et al. | 68/180 |
| 3,067,602 | 12/1962 | Brunt | 68/180 |
| 3,206,777 | 9/1965 | Shibata | 68/180 |
| 3,448,470 | 6/1969 | Newton | 68/180 |
| 4,541,255 | 9/1985 | Arashi | 68/180 |
| 4,922,733 | 5/1990 | Driesen et al. | 68/180 |
| 4,939,914 | 7/1990 | Driesen et al. | 68/180 |
| 5,758,376 | 6/1998 | Meyer et al. | 68/180 |
| 5,791,165 | 8/1998 | Harten et al. | 68/180 |

FOREIGN PATENT DOCUMENTS

| | | |
|---|---|---|
| 1333808 | 12/1963 | France . |
| 53-038784 | 4/1978 | Japan . |

*Primary Examiner*—Frankie L. Stinson
*Attorney, Agent, or Firm*—Kenyon & Kenyon

[57] ABSTRACT

A jig is used to dye a textile web made of polyester fibers (PES fibers) or a blend of PES fibers with other fibers. Dye liquor is kept at boiling temperature or just slightly below the boiling temperature. Provided in the housed-in steam space above the dye liquor are steam-spray tubes which act on the textile web. The steam-spray tubes direct saturated steam upon the textile web as it winds onto the respective reeling lap roll.

10 Claims, 1 Drawing Sheet

METHOD OF DYEING CONTINUOUS STRIPS OF TEXTILE FABRIC MADE OF POLYESTER FIBER OR MIXTURES OF POLYESTER WITH OTHER FIBERS, AND JIGGER FOR CARRYING OUT THE METHOD

BACKGROUND OF THE INVENTION

The invention relates to a method and a jig for dyeing textile webs made of polyester fibers (PES fibers) or blends of PES fibers with other natural fibers, particularly cellulosed fibers such as cotton, but also, inter alia, linen and wool, as well as synthetic fibers such as viscose fibers, among other. In the method, a continuous material is unwound from a fabric batch, conducted through a dye bath, and subsequently reeled again to form a fabric batch. This process is repeated in each case by reversing the direction of the web movement.

The receptivity of polyester fibers to dyes is considerably poorer compared to other customary textile fibers. This is due to their closed structure, and their high degree of orientation. This results in low swelling capacity and hydrophobic properties. In addition, the polyester fiber contains no free dye sites and has only a slight affinity for water-soluble dyes.

With but a few exceptions, only disperse dyes are usable for polyester fibers, and then the polyester textiles are dyed according to the following three basic methods:

1) Dyeing at temperatures up to 100° C. on dyeing machines operating at atmospheric pressure, using special aids—the so-called "Carrier";
2) Dyeing at temperatures between 120° C. and 130° C. on "HT" (high-temperature) dyeing machines operating at elevated pressure;
3) Thermosol dyeing method in which the dye applied on the material is set by dry heat in the temperature range of 190° C. to 220° C.

Because of the comparatively low liquor pickup of approximately 35%, the thermosol method is disadvantageous for the dyeing of textile webs made 100% of polyester fibers. The evenness of the dye take-up leaves something to be desired, in particular. Moreover, like all continuous methods, the thermosol method is only economically suitable for larger dye lots.

Dyeing with the aid of carriers (the first approach listed above) was frequently utilized primarily during the first phase of the introduction of polyester fibers into textile production. Today, however, its use has fallen off sharply. The carriers already permit sufficient swelling of the PES fibers at temperatures of 95° C., and thus promote the diffusion of the dye into the PES fibers. However, the carriers are usually toxic, and their use is not in harmony with protection of the environment.

Therefore, predominantly high-temperature dyeing from 120° C. to 130° C. is used as an exhaust-dyeing process. However, it is only possible to dye at temperatures over 100° C. on equipment which is constructed for an excess pressure corresponding to the temperature range indicated.

Thus, it is known to use a "HT jig" for dyeing PES fibers with disperse dyestuff, said HT jig permitting a dyeing temperature in the range from 120° C. to 130° C. For this purpose, the jig housing must withstand a steam pressure between approximately 2 and 5 bar. The construction and operation of such an installation are correspondingly costly.

The French patent FR-A-1333808 discloses a jig for, among other things, dyeing polyester, in which, before the web is reeled onto one of the lap rolls, steam is sprayed onto the fabric web from both sides, the intention being for the steam to pass over the surface of the fabric. After applying the steam, and before winding onto the lap roll, the fabric web passes a guide roll/fabric spreader combination. However, this specific design is less than optimal, and can be improved upon.

SUMMARY OF THE INVENTION

Given the aforementioned limitations and disadvantages of prior art approaches, the object underlying the invention is to improve the dyeing of textile webs made of polyester and its blends.

The invention includes a method for dyeing textile webs made of polyester fibers (PES fibers) or blends of PES fibers with others in a dye bath in a jig, in which the textile web is unwound from the one lap roll of the jig, is passed through the dye bath, and is subsequently wound immediately again onto the other lap roll of the jig. The winding direction is reversible after the run-through of the length of the textile web. The dyeing is carried out under atmospheric pressure without air inlet or exchange with the ambient atmosphere in such a way that the boiling temperature of the dye liquor, or a temperature immediately below the boiling temperature is maintained in the dye bath. The temperature of the textile web is additionally raised before winding onto the respective reeling lap roll by blowing saturated steam onto the textile web directly in the reeling-on gap.

A decisive factor for dyeing PES is the dyeing temperature. In pressureless (atmospheric) dyeing machines, not more than the boiling temperature of the liquor can be achieved which, as is well known, is dependent on the height of the location above the sea. Given a height above sea level of approximately 300 m, the maximum achievable temperature in closed dyeing vessels lies at about 98° C. to 99° C., and indeed, on condition that the cover area of the jig is perfectly sealed.

In the invention, the textile web, after its emergence from the dye bath which is at or just below the boiling point, is brought to the saturated-steam temperature of 100° C. by supplying heat energy directly to the web in the reeling-on gap and by using the condensation heat, and wound up under these operating conditions. Thus, the elevated temperature is "wrapped in", so to speak, and thereby aids the dye absorbing process. A temperature gain of only a few degrees already results in a noticeable increase in dye utilization of several per cent. Due to the measure according to the invention, the maximum temperature increase possible under atmospheric pressure is thus ensured and is utilized to improve the results of the method. The invention makes it possible to dye textile webs, including polyester fibers, with good depth and fastness of color in a comparatively simple device that does not need a pressure-resistant housing and which uses comparatively little energy, without the fabric having to pass through the dye bath many times.

The dyeing success attainable by the invention is increased by a suitable dyestuff selection. Those disperse dyestuffs are chosen which diffuse into the polyester fibers under the conditions indicated, i.e. at temperatures of approximately 100° C., and dye them. Moreover, the selection is determined by fulfilling the following criteria:

a) Dye utilization when dyeing under atmospheric pressure at least 65% or more, given 2% dye, i.e. given 2% of the fabric weight in dyestuff in the liquor.

b) Light fastness, given equal depth of color, at least 5 (German Industrial Standard DIN 54004).

c) Laundering fastness at 60° C., at least 4/4–5/4–5 (DIN 54010).

d) Fastness in the reductive medium.

The following types of dyestuff from the group of disperse dyestuffs have proven to be particularly advantageous in this sense for dyeing textile webs, made of PES fibers, according to the method of the present invention:

Color Index Disperse Yellow 3 such as Cellitongelb G (BASF)

Color Index Disperse Yellow 60 such as Resolingelb RL (Bayer)

Color Index Disperse Yellow 68 such as Samarongoldgelb HGL (Hoechst)

Color Index Disperse Orange 3 such as Cellitonorange GR (BASF)

Color Index Disperse Red 1 such as Cibacetscharlach 2B (Ciba-Geigy)

Color Index Disperse Red 50 such as Resolinscharlach RR (Bayer)

Color Index Disperse Violet 1 such as Cibacetviolett 2R (Ciba-Geigy)

Color Index Disperse Blue 81 such as Resolinblau GRL (Bayer)

These dyestuffs, in the broadest sense, are "small-molecular" disperse dyestuffs, thus "low energy" types having high migrating power, i.e. dyestuffs needing little energy for penetrating into the fibers, as well as acceptable fastness to sublimation. This also holds true—with certain restrictions —for "medium-molecular" disperse dyestuffs, the "medium energy" types having sufficient migrating power, as well as very good fastness to sublimation. Large-molecular disperse dyestuffs or "high energy" types having low migrating power and maximum fastness to sublimation prove, as a rule, to be less suitable to unsuitable.

The disperse dyestuffs named meet the criteria mentioned above. Trichromaticities to the extent necessary are also possible with these dyestuffs. In addition, an adequate fastness to sublimation is assured. Better dyeing results are attained in particular with the types of dyestuff named, in interaction with the additional temperature rise, and thus at elevated dyeing temperatures.

Another important influencing factor for improving the dyeing results in the method of the present invention is the liquor ratio, i.e. the concentration gradient. The concentration gradient influences the diffusion of dyestuff into the fibers.

According to the invention, dyeing should be carried out in the liquor-ratio range of 1:1.3 to 1:2.5. This results in a doubling of the dyestuff concentration in the dye liquor compared to the conventional jigs. This factor also contributes very perceptibly to the dye utilization.

In accordance with one advantageous aspect of the invention, a film-former (e.g., acrylamide polymers) is added to the dye liquor, which increases the liquor carrying capacity on the PES fiber textile web.

A jig for dyeing textile webs in accordance with the method is also presented. The jig is contained within a sealable housing which is accessible for the exchange of batches, but which is otherwise sealed. Two lap rolls are rotationally mounted in the housing that can be bidirectionally driven, so that a textile web can be wound back and forth between them. At least one dye bath is provided, through which the textile web passes during the winding. A heating device keeps the dye bath at or just below the boiling temperature of the dye liquor, under essentially atmospheric pressure within the housing. Additional steam-spray tubes are arranged to extend across the width of the textile web. Some of the steam-spray tubes face the lap side of the textile web in a reeling-on gap directly before the textile web is wound onto the respective reeling lap roll, subjecting the web to temperature elevating steam.

BRIEF DESCRIPTION OF THE DRAWING

Further features of the invention will be explained in terms of the following detailed description in conjunction with the drawing, which provides a perspective view of an embodiment of a two-reservoir jig, shown partially in section.

DETAILED DESCRIPTION

Figure 1:
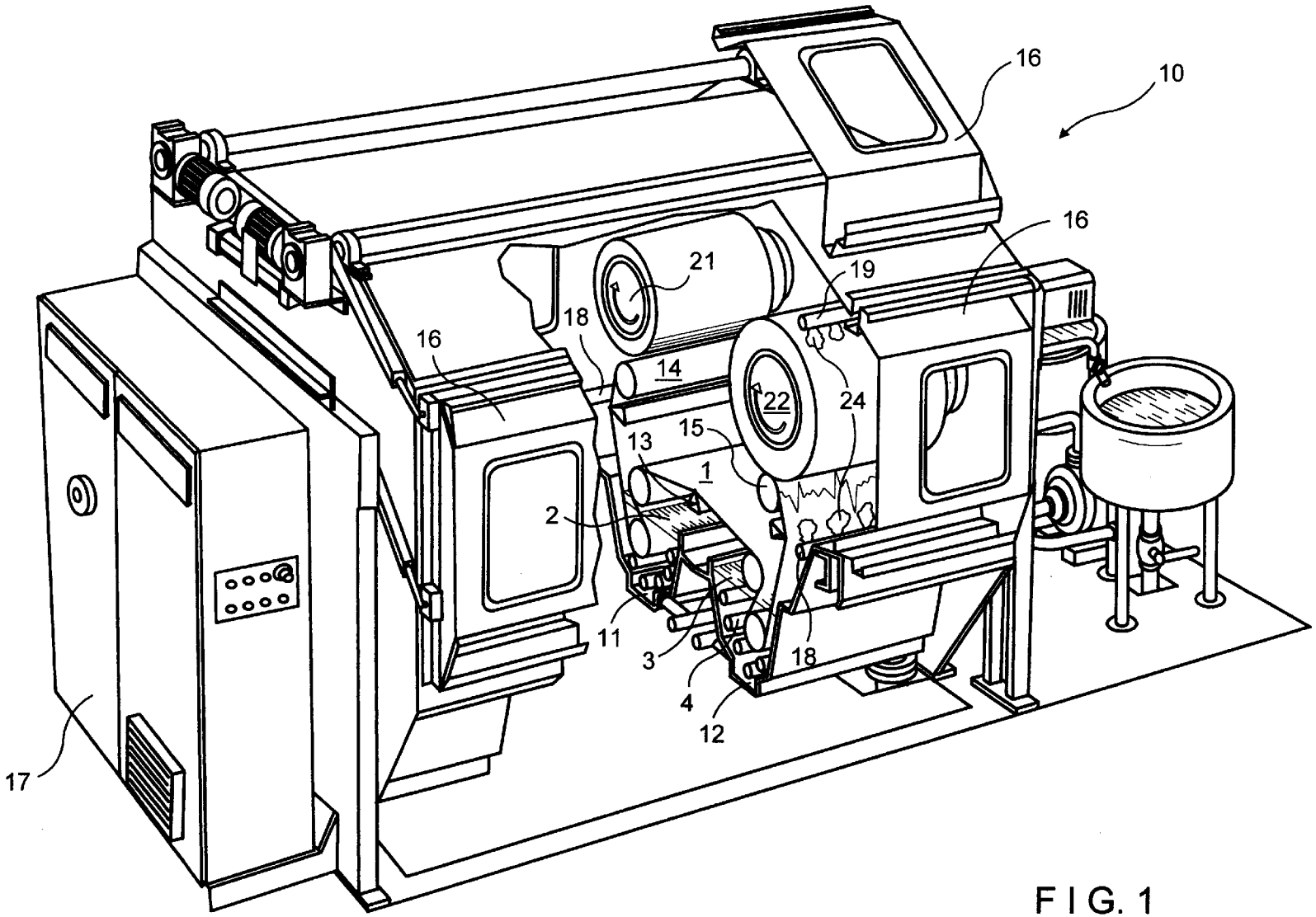

The jig includes, in a housing 10, two lap rolls 21 and 22, between which a textile web 1 made of PES fibers is wound back and forth, and between which are arranged two small reservoirs 11 and 12 usable in alternation or one after the other in the same run-through, as well as a vertically adjustable width-adjusting/coating (spreading) tube 13 in between. Also provided are tension rolls 14 and 15 that are can be pressed with adjustable force against lap rolls 21 and 22 and which are intended to support a clean lap formation. Housing 10 is effectively sealed in suitable manner against the penetration of, or the exchange with, outside air. It has an entrance hatch 16 which can tilt for the exchange of batches.

Using a control and regulating unit 17, as well as associated thermal detectors (not shown in the drawing), dye liquors 2 and 3 in reservoirs 11 and 12 are adjusted with the aid of radiators 4 to a temperature which is the same as or only slightly—for example 1° C.—less than the boiling temperature point of the dye liquors under the prevailing atmospheric pressure conditions.

In the space above dye reservoirs 11 and 12, of which only one can be used as well, steam-spray tubes 18 and 19, provided with nozzles along their longitudinal extension and conveying saturated steam, are arranged in such a way that, in the area of the lap roll onto which textile web 1 of PES fibers is just being wound (in the drawing, this is lap roll 22), textile web 1 is jet-sprayed with saturated steam 24 over the entire web width. Steam-spray tubes 18 are arranged directly in advance of the location where textile web 1 winds onto the roll lap and act in the reeling-on gap to spray steam against the side of textile web 1 facing the lap roll during reeling, so that said side winds onto the lap roll immediately with the attained temperature increase of a few degrees. Steam-spray tubes 19 act to spray steam against the outer surface of the lap roll. With this jet-spray, the temperature, at least in the zone of textile web 1 running into the fabric batch, as well as at the periphery of the fabric batch, is increased to saturated-steam temperature.

The addition of "film formers" to the dye liquor for PES fibers in reservoirs 11 and 12 has proven to be of considerable advantage. By the addition of film-forming means on the basis of acrylamide polymers, it was possible to increase the liquor pickup by 10%. The greater liquor volume had a particularly advantageous effect within the wound goods, because the dyestuff addition during the period of dwell on the fabric batch was higher, and the dyestuff diffusion was accelerated. Moreover, a greater dyeing evenness was ascertained. Even 3 to 5 g of a film former on the basis of acrylamide polymers per liter of dye liquor has been shown to be sufficient for this purpose.

The following dyeing experiments were conducted on the jig described:

Example 1:

| | | | |
|---|---|---|---|
| Material: | Decorative fabric made of 100% PES (prewashed) 1200 m, 246.4 kg | | |
| Dye liquor: | 400 1 | | |
| Liquor ratio: | 1:1.62 | | |
| Dyeing formulation | Disperse Orange 3 | 1.2% | |
| | Disperse Blue 81 | 0.55% | |
| | Polymerization product on acrylamide base | 4 g/l | |
| | pH | 5.5 | |
| | | Temperature | |
| | | Liquor | Space |
| Passage 1,2 | Dosing dyestuff | 70° C. | 70° C. |
| 3,4 | Dyeing | 90° C. | 90° C. |
| 5–8 | Dyeing | 99° C. | 100° C. |
| 9 | Hot rinsing | 80° C. | 80° C. |
| 10,11 | Reductive cleaning | 60° C. | 60° C. |
| | NaOH 2 g/l | | |
| | $Na_2S_2O_4$ 4 g/l | | |
| 12 | Hot rinsing | 60° C. | 60° C. |
| 13 | Rinsing | 40° C. | 40° C. |
| 14,15 | Cold rinsing | 20° C. | 20° C. |
| Velocity: | During dyeing | 80 m/min. | |
| | Rinsing | 140 m/min. | |

Example 2:

| | | | |
|---|---|---|---|
| Material: | Fabric made of 100% PES 2150 m, 395 kg | | |
| Dye liquor: | 650 1 | | |
| Liquor ratio: | 1:1.65 | | |
| Dyeing formulation: | Disperse Yellow 60 | 0.21% | |
| | Disperse Red 50 | 0.15% | |
| | Disperse Violet | 0.62% | |
| | pH | 5.5 | |
| | | Temperature | |
| | | Liquor | Space |
| Passage 1,2 | Dosing dyestuff | 70° C. | 70° C. |
| 3–8 | Dyeing | 99° C. | 100° C. |
| 9 | Hot rinsing | 80° C. | 80° C. |
| 10 | | 60° C. | 60° C. |
| 11 | | 40° C. | 40° C. |
| 12 | Cold rinsing | 20° C. | 20° C. |
| Velocity: | Dyeing | 100 m/min. | |
| | Rinsing | 140 m/min. | |

What is claimed is:

1. A method for dyeing textile webs made of polyester fibers or blends of polyester fibers with other fibers in a dye bath in a jig that has a first lap roll, a dye bath, and a second lap roll spaced from the dye bath via a reeling-on gap, comprising the steps of:

unwinding the web from one of the lap rolls of the jig;

passing the web through the dye bath;

raising the temperature of the textile web an additional amount just prior to winding it onto the lap roll acting as a reeling roll by blowing saturated steam onto the textile web directly onto the web in advance of the location where the textile web winds onto the lap roll against the side of the textile web facing the lap roll;

winding the web immediately onto that lap roll acting as a reeling roll of the jig, the winding direction being reversible after the run-through of the length of the textile web;

wherein the dyeing is carried out under atmospheric pressure without air inlet or exchange with the ambient atmosphere in such a way that the boiling temperature of the dye liquor, or a temperature immediately below the boiling temperature is maintained in the dye bath.

2. The dyeing method as defined by claim 1, wherein one or a plurality of the following types of dyestuff are present in the dye bath:

Color Index Disperse Yellow 3

Color Index Disperse Yellow 60

Color Index Disperse Yellow 68

Color Index Disperse Orange 3

Color Index Disperse Red 1

Color Index Disperse Red 50

Color Index Disperse Violet 1

Color Index Disperse Blue 81.

3. The dyeing method as defined by claim 2, wherein the liquor ratio is 1:1.3 to 1:2.5.

4. The dyeing method as defined by claim 3, wherein a film former to increase the liquor-carrying capacity on the textile web of PES fibers is added to the dye liquor.

5. The dyeing method as defined by claim 1 wherein the liquor ratio is 1:1.3 to 1:2.5.

6. A method for dyeing textile webs made of polyester fibers or blends of polyester fibers with other fibers in a dye bath in a jig that has a first lap roll, a dye bath, and a second lap roll spaced from the dye bath via a reeling-on gap, comprising the steps of:

unwinding the web from one of the lap rolls of the jig;

passing the web through the dye bath;

raising the temperature of the textile web an additional amount just prior to winding it onto the lap roll acting as a reeling roll by blowing saturated steam onto the textile web directly in the reeling-on gap preceding that lap roll;

winding the web immediately onto that lap roll acting as a reeling roll of the jig, the winding direction being reversible after the run-through of the length of the textile web;

wherein the dyeing is carried out under atmospheric pressure without air inlet or exchange with the ambient atmosphere in such a way that the boiling temperature of the dye liquor, or a temperature immediately below the boiling temperature is maintained in the dye bath, and wherein a film former to increase the liquor-carrying capacity on the textile web of PES fibers is added to the dye liquor.

7. The dyeing method as defined by one of claims 6, wherein the film former on the basis of acrylamide polymers is used.

8. A jig for dyeing textile webs made of polyester fibers or blends of polyester fibers with other fibers in a dye bath, comprising:

a sealable housing which is accessible for the exchange of batches, but which is otherwise sealed;

two lap rolls rotationally mounted in the housing that can be bidirectionally driven, so that a textile web can be wound back and forth between them;

at least one dye bath, through which the textile web passes during the winding;

a heating device for keeping the dye bath at or just below the boiling temperature of the dye liquor, under essentially atmospheric pressure within the housing;

additional steam-spray tubes, arranged to extend across the width of the textile web, at least some of said steam-spray tubes being arranged to face the lap side of the textile web in a reeling-on gap directly before the textile web is wound onto the respective reeling lap roll, subjecting that side of the textile web that faces the lap roll to the action of saturated steam wherein the tubes are oriented so that pockets of condensed steam do not form in the vicinity of the location where the steam strikes the web.

9. A jig as set forth in claim 8, further comprising steam-spray tubes arrayed across the width of the web and so arranged as to subject the outer surface of the textile web to temperature-raising steam as the web is wound onto the reeling lap roll.

10. A jig as set forth in claim 9, further comprising two reservoirs.

* * * * *

UNITED STATES PATENT AND TRADEMARK OFFICE

CERTIFICATE OF CORRECTION

PATENT NO. : 6,036,728
DATED : March 14, 2000
INVENTOR(S) : Drahomir Dvorsky

It is certified that error appears in the above-identified patent and that said Letters Patent is hereby corrected as shown below:

Title page, item [54] column 1,
Lines 1-6, the title to read (as previously amended), -- METHOD FOR DYEING TEXTILE WEBS MADE OF POLYESTER FIBERS OR BLENDS OF POLYESTER FIBERS WITH OTHER FIBERS, AND SUITABLE JIG --.

Signed and Sealed this

Eleventh Day of September, 2001

*Attest:*

Nicholas P. Godici

NICHOLAS P. GODICI
*Acting Director of the United States Patent and Trademark Office*

*Attesting Officer*